United States Patent [19]

Herrick

[11] Patent Number: 4,531,734

[45] Date of Patent: Jul. 30, 1985

[54] TENNIS PRACTICE DEVICE

[76] Inventor: Robert M. Herrick, 627 Grant Ave., Fort Leavenworth, Kans. 66027

[21] Appl. No.: 636,109

[22] Filed: Jul. 30, 1984

[51] Int. Cl.[3] ..... A63B 61/00

[52] U.S. Cl. ..... 273/29 A; 273/58 C

[58] Field of Search ..... 273/29 A, 26 R, 26 E, 273/185 D, 184 B, 196, 197 R, 197 A, 58 C

[56] References Cited

U.S. PATENT DOCUMENTS

| | | | |
|---|---|---|---|
| 1,826,221 | 10/1931 | Pearson | 273/58 C |
| 2,578,313 | 12/1951 | Mosley | 273/29 A |
| 2,713,487 | 7/1955 | Jaediker | 273/29 A |
| 3,051,491 | 8/1962 | Cabot | 273/200 R |
| 3,147,978 | 9/1964 | Wolfe | 273/58 C |
| 3,924,853 | 12/1975 | Schleeger | 273/185 D |
| 4,089,521 | 5/1978 | Berst | 273/29 A |
| 4,307,888 | 12/1981 | Ohle | 273/58 C |
| 4,417,730 | 11/1983 | Weiner | 273/29 A |

FOREIGN PATENT DOCUMENTS

| | | | |
|---|---|---|---|
| 25611 | 6/1935 | United Kingdom | 273/200 R |

*Primary Examiner*—Richard C. Pinkham
*Assistant Examiner*—T. Brown
*Attorney, Agent, or Firm*—Schmidt, Johnson, Hovey & Williams

[57] ABSTRACT

A tennis practice device for indoor use has a swingable upright arm pivotally connected to a weighted base. A tennis ball is connected to the top of the arm, and movement of the arm is limited and dampened by two cushions. An elastic strap normally holds the arm against one of the cushions. In the arm, an elongated wire with a spring trunk is surrounded by lengths of tubing arranged in telescopic fashion. The arm is resilient and capable of whip-like movement, rendering the impact resistance presented by the ball against a racquet similar to the resistance of a ball in actual play. Simultaneously, the combination of the pivot means with the resilient nature of the arm permits the ball to escape the follow-through stroke of the racquet, yet quickly return to its normal position to allow the tennis player to repeat strokes in rapid succession.

2 Claims, 6 Drawing Figures

TENNIS PRACTICE DEVICE

BACKGROUND OF THE INVENTION

1. Field of the Invention

This invention relates to a device for practicing racquet strokes against a ball, the ball being attached to an upper end of a swingable arm.

2. Description of the Prior Art

Tennis players have very few means for improving their style of play, aside from actual engagement in a game with another player or players. Typically, for solitary practice, the athlete would hit a tennis ball toward a large, vertical wall, and the ball would then rebound back to the player. Preferably, the wall would have a single, horizontal painted line to simulate the top of the net found in a tennis court. While the use of such a wall may be helpful for obtaining exercise and improving aim, basic tennis strokes cannot efficiently be practiced on such a device. Most players must direct their attention on running toward the ball and returning the same to the wall, and therefore have little time to concentrate on the actual stroke, racquet grip, and movement of their arms and legs. The quick response necessary for practice against the wall increases the likelihood that the player will repeat bad habits which could irrevocably become engrained in the player's style.

Additionally, numerous other disadvantages are inherent in the use of a wall for practice. Generally, such walls are affixed to one portion of a fence surrounding an outdoor tennis court. Consequently, practice against the wall is prohibited during periods when the court is used for actual play or when inclement weather exists. Also, such courts are not commonly found on residential lots and the athlete is forced to travel some distance before use. During practice, much time may be wasted chasing balls that have erroneously been hit over, under, or to one side of the wall. Additionally, the wall surfaces normally are wooden and consequently subject to warpage and frequent painting.

SUMMARY OF THE INVENTION

According to my invention, a tennis ball is attached to the upper end of a flexible arm. The arm is swingable on pivot means between two horizontally spaced cushioned stops. An elastic strap yieldably biases the arm against one of the stops to ready the ball for impact from a racquet.

When the ball is struck, movement occurs due to both the swingable nature of the arm around the pivot means, and also due to the flexible nature of the arm itself. Consequently, the slight impact resistance of the ball against the racquet simulates the resistance of a ball during actual play. The player is consciously able to improve his grip, swing and stance by responding to the feeling of this impact resistance without changing positions, running to a different location, or retrieving an erroneously hit ball.

Also, the combination of the pivot means with the flexible or bendable nature of the arm permits the tennis ball to move ahead of the racquet after impact and escape the follow-through stroke normally provided by the player, thus preventing a potentially damaging collision between the racquet and the arm. However, due to the elastic strap, the arm with the attached ball quickly returns to its normal position against one of the cushioned stops, ready for another hit from the player.

Furthermore, my device is of simple and inexpensive construction, and may be stored in a very small space. The invention lends itself to convenient indoor practice, where inclement weather will not be a detriment. Also, the expense of building and maintaining a large outdoor practice area is eliminated.

DETAILED DESCRIPTION

Figures 1, 2, 3, 4, 5, 6:
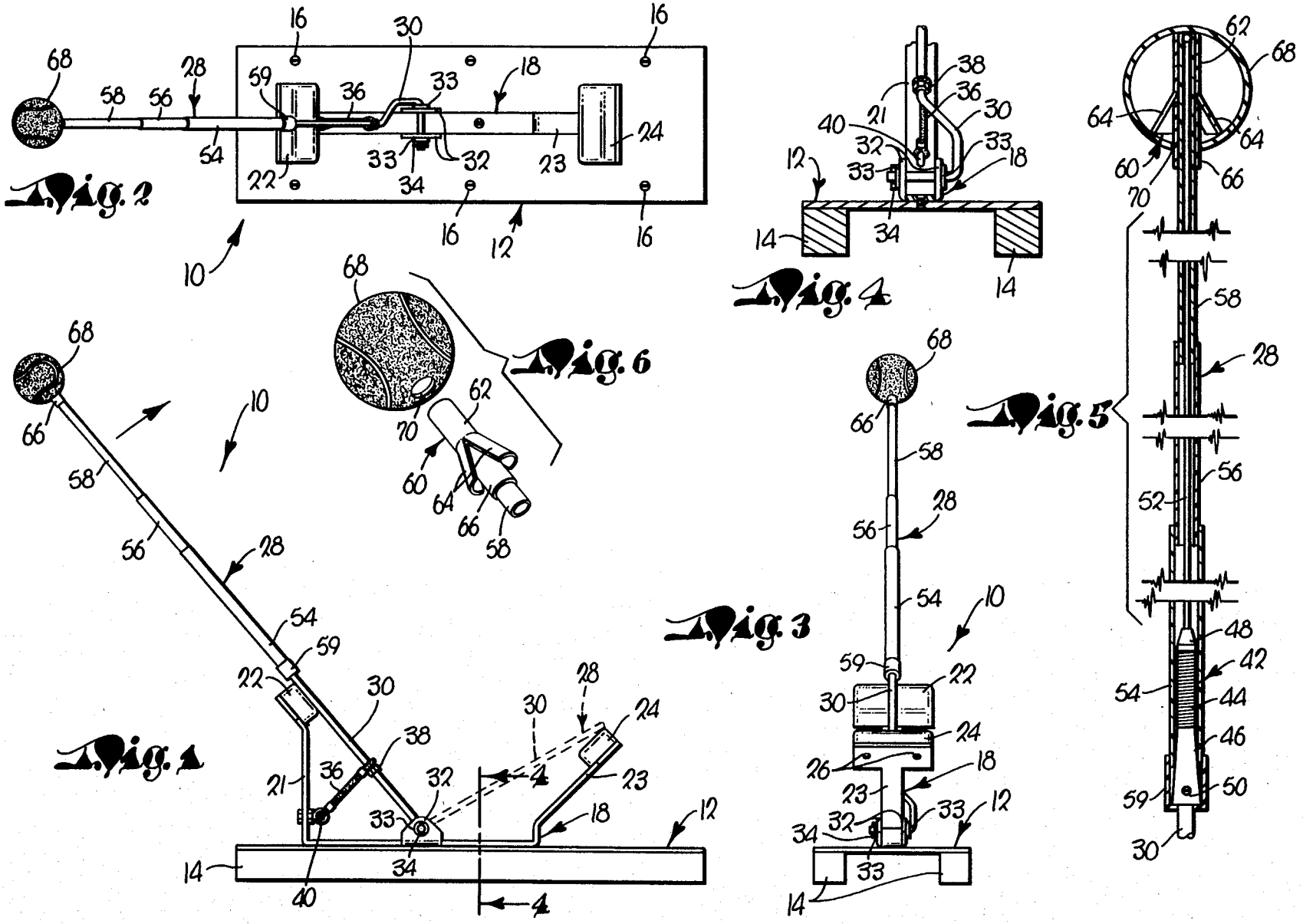
FIG. 1 is a side elevational view of a tennis practice device made pursuant to my present invention.
FIG. 2 is a top plan view thereof.
FIG. 3 is an end elevational view thereof.
FIG. 4 is an enlarged, fragmentary, transverse cross-sectional view taken along line 4—4 of FIG. 1.
FIG. 5 is an enlarged, fragmentary, cross-sectional view of the arm and ball.
FIG. 6 is an exploded, enlarged, perspective view of the tennis ball and anchor.

A tennis practice device 10, as best shown in FIGS. 1-3, has a horizontally elongated base 12 and a pair of elongated, horizontal legs 14 of substantial weight attached to the base 12, as by screws 16. An essentially U-shaped support 18 has an elongated bight attached to the base 12 by screws 20. The support 18 has a first upstanding leg 21 and a second upwardly inclined leg 23 to which cushions 22 and 24 are respectively connected, at the upper ends of the corresponding legs, by screws 26, such that the cushions 22, 24 are horizontally spaced from each other.

An elongated, transversely circular arm 28 includes a lower, metal rod 30. The bottom portion of the rod 30 is substantially L-shaped and pivots about a substantially horizontal axis within two mating holes in an upstanding bracket 32 integral with the support 18. Washers 33 are placed on the rod 30 on each side of the bracket 32, and a cotter pin 34 is threaded through a hole adjacent the lower free end of the rod 30 to retain the latter within the bracket 32.

A elastic strap 36 has a normally upper end looped around the rod 30 at a position immediately above a stop 38 on the rod 30. The lower end of the strap 36 is threaded through an eyebolt 40 attached to the leg 21 of the support 18.

The upper portion of the arm 28 includes a spring trunk, broadly designated by the numeral 42, comprised of a spring 44 rigidly secured to a pair of frustum-shaped end elements 46, 48. A setscrew 50 clamps the lower end of element 46 to the rod 30. An elongated, flexible wire member 52 is attached to the upper end element 48 and extends upwardly from the latter.

The spring trunk 42 and the wire member 52 are surrounded by three flexible, hollow, polyvinyl chloride tubes 54, 56, 58 which are relatively telescoped and decrease in diameter as the upper end of the arm 28 is approached. A hollow, cylindrical cap 59, secured to a lower portion of lower tube 54, engages the lower end of the element 46 and has a hole through which the rod 30 extends.

An expansion-type anchor 60 is comprised of an upper shell 62 with three integral, expandable anchoring prongs 64 and a separate, lower sleeve 66. The shell 62 is secured adjacent the upper end of the upper tube 58. When a hollow tennis ball 68, having a hole 70, is pushed over the shell 62, the three prongs 64 are forced inwardly until the shell 62 is completely within the ball 68, whereupon the three prongs 64 spring to their normal outwardly inclined position and engage the interior wall of the ball 68. Subsequently, the sleeve 66, carried by the upper tube 58, is inserted within the hole 70 until the top edge of the sleeve 66 bears against the prongs 64 thus preventing retraction of the three prongs 64 from their ball-engaging position.

OPERATION

In use, the strap 36 normally retains the arm 28 in a position against the cushion 22 At rest, the ball 68 is 24 to 28 inches vertically above the floor or ground below the legs 14, such that the player may comfortably repeat in succession either forehand or backhand strokes. The normally inclined position of the arm 28, as shown by the full line position in FIG. 1, permits a racquet to contact the ball 68 without simultaneously engaging the tubes 54, 56, 58, thereby precluding possible damage to the latter and also to the racquet frame.

When the ball 68 is struck, the arm 28 moves in a direction as shown by the arrow in FIG. 1. The cushion 24 limits the swinging movement of the arm 28 to the position shown by the dashed lines in FIG. 1. The strap 36, due to its elastic nature, then returns the arm 28 to its normal position against the cushion 22. The cushions 22, 24 dampen the impact of the arm 28 as it reaches each end of its path of travel.

The telescopic arrangement of the tubes 54, 56, 58 renders the upper portion of the arm 28 increasingly flexible as the ball 68 is approached. However, the wire member 52, while also being somewhat flexible, is of a stiffness to limit the extent of bending of the tubes 56, 58 to preclude bending failure of the latter. The spring 44 is also bendable but is stiffer than the wire member 52, and, similarly, the spring 44 prevents bending failure of the lower tube 54.

Consequently, when the ball 68 is hit, the upper portion of the arm 28 bendably yields in response. The arm 28 will have a greater angle of deflection as the ball 68 is approached. Simultaneously, a portion of the impact force will be translated down to the relatively stiff rod 30 and will overcome the elastic resistance of the strap 36, causing the rod 30 to pivot within the bracket 32. Thus, in use, the arm 28 reacts to an impact force against the ball 68 by both bendably yielding in the upper portion of the arm 28 and also by swingably moving around the bracket 32.

As a result, the tennis practice device 10 simulates the condition of a tennis ball in actual play. The flexible upper portion of the arm 28 causes the ball 68 to offer very little resistance, similar to the resistance presented by a ball in flight during actual play. The player is able to "feel" his mistakes during practice and adjust his grip, stance, and swing accordingly.

The decreasing flexibility of the arm 28 as the rod 30 is approached also provides the arm 28 with a self-damping nature. After the ball 68 is struck, the internal oscillation of the arm 28 is progressively suppressed while simultaneously the strap 36 returns the arm 28 to its normal position against the cushion 22. Consequently, the ball 68 is soon motionless and ready for another impact by the tennis player.

While the tennis practice device 10 has been substantially shown and described for use in tennis practice, it is to be understood that the device should not be limited to this specific use. It is to be appreciated that my invention may be used for the practice of many other games, such as racquetball and squash, merely by substituting an appropriate ball for the illustrated tennis ball 68.

I claim:

1. A device for the practice of hitting a ball, comprising:
   - a support;
   - an elongated arm;
   - pivot means mounting the arm on the support for swinging movement;
   - a ball secured to the arm remote from said pivot means;
   - stop means carried by the support within the path of travel of the arm for limiting the extent of swinging movement of the arm; and
   - elastic means interconnecting the arm and the support for yieldably biasing the arm toward one end of its swinging movement,
   - a portion of said arm extending from the ball toward said pivot means being flexible rendering the same bendable in response to hitting the ball,
   - said portion being tubular and surrounding an internal elongated wire member, said member being attached to a spring trunk in alignment therewith, said trunk including a spring rigidly secured to a pair of end elements.

2. A device for the practice of hitting a ball, comprising:
   - a support;
   - an elongated arm;
   - pivot means mounting the arm on the support for swinging movement;
   - a ball secured to the arm remote from said pivot means;
   - stop means carried by the support within the path of travel of the arm for limiting the extent of swinging movement of the arm; and
   - elastic means interconnecting the arm and the support for yieldably biasing the arm toward one end of its swinging movement,
   - said support comprising a generally U-shaped frame having an elongated bight and two upright legs, the upper end of each leg supporting one of said stops.

* * * * *